US007784138B2

(12) United States Patent
Spooner

(10) Patent No.: US 7,784,138 B2
(45) Date of Patent: Aug. 31, 2010

(54) DEVICE FOR CONVERTING A ROTATING MOTION INTO A RECIPROCATING MOTION AND AN ELECTRIC TOOL ASSEMBLY HAVING SUCH A DEVICE

(75) Inventor: Gregory Clegg Spooner, Causeway Bay (HK)

(73) Assignee: Hayco Manufacturing Limited, Hong Kong (HK)

( * ) Notice: Subject to any disclaimer, the term of this patent is extended or adjusted under 35 U.S.C. 154(b) by 1244 days.

(21) Appl. No.: 11/058,971

(22) Filed: Feb. 16, 2005

(65) Prior Publication Data

US 2006/0179591 A1 Aug. 17, 2006

(51) Int. Cl.
*A46B 13/02* (2006.01)
*A61C 17/34* (2006.01)

(52) U.S. Cl. ..... 15/22.2; 15/22.1

(58) Field of Classification Search ..... 15/22.1, 15/22.2, 28

See application file for complete search history.

(56) References Cited

U.S. PATENT DOCUMENTS 3,160,902 A * 12/1964 Aymar ..... 15/22.1
5,033,150 A * 7/1991 Gross et al. ..... 15/22.1
5,253,382 A * 10/1993 Beny ..... 15/22.1
5,311,633 A * 5/1994 Herzog et al. ..... 15/28
5,448,792 A 9/1995 Wiedemann et al.
6,453,498 B1 * 9/2002 Wu ..... 15/22.1
6,836,918 B1 * 1/2005 Wong ..... 15/22.1
7,065,821 B2 * 6/2006 Fattori et al. ..... 15/22.2
7,251,896 B2 * 8/2007 Khubani ..... 30/199
7,356,866 B2 * 4/2008 Chan ..... 15/22.1
2003/0226223 A1 * 12/2003 Chan ..... 15/22.2

* cited by examiner

*Primary Examiner*—Randall Chin
(74) *Attorney, Agent, or Firm*—Ostrolenk Faber LLP

(57) ABSTRACT

A device for converting a rotating motion into a reciprocating motion comprises a rotatable shaft carrying a first grooved element, a second element constrained to move along an axis of said second element, and a pin carried on the second element. The pin may be engaged in the groove on the rotatable shaft so that as the rotatable shaft rotates, the pin moves in the groove thereby causing the second element to move along its axis. The shape of the groove defines the motion of the second element. There is also disclosed an electric brush assembly and an electric tool assembly comprising such a device.

18 Claims, 5 Drawing Sheets

DEVICE FOR CONVERTING A ROTATING MOTION INTO A RECIPROCATING MOTION AND AN ELECTRIC TOOL ASSEMBLY HAVING SUCH A DEVICE

FIELD OF THE INVENTION

The present invention relates to a device for converting a rotating motion into a reciprocating motion for use, for example, in an electric brush assembly, and an electric tool assembly having such a device.

BACKGROUND OF THE INVENTION

It is a common requirement in many mechanisms to convert a rotating motion into a reciprocating motion or a reciprocating motion into a rotating motion. Typical examples of this requirement are internal combustion or steam engines and cutting or stamping machines. It is common practice to achieve the conversion using cranks and crankshafts or Scotch Yokes. However, such devices require considerable space, usually in the axis of the reciprocating motion and are therefore inconvenient, particularly in small hand-held devices such as electric brushes. Thus, there is a need for a compact, lightweight mechanism to achieve the conversion, particularly for use in small hand-held devices.

SUMMARY OF THE INVENTION

In general terms, the present invention proposes a device for converting a rotating motion into a reciprocating motion and/or a device for converting a reciprocating motion into a rotating motion.

According to a first aspect of the present invention there is provided a device for converting a rotating motion into a reciprocating motion comprising:

- a rotatable shaft carrying a first element having a groove therein;
- a second element constrained to move along an axis of the second element; and
- a pin carried on the second element for engagement in the groove in the first element so that as the rotatable shaft rotates, the pin is arranged to move in the groove thereby causing the second element to move along the axis, the shape of the groove defining motion of the second element.

According to a second aspect of the present invention there is provided an electric tool assembly comprising the device defined above.

According to a third aspect of the present invention there is provided an electric brush assembly comprising the device defined above.

An advantage of one or more embodiments of the invention is that the mechanism is simple to construct and may be used in small devices such as electric brushes.

BRIEF DESCRIPTION OF THE DRAWINGS

Preferred features of the invention will now be described, for the sake of illustration only, with reference to the following figures in which.

DETAILED DESCRIPTION OF PREFERRED EMBODIMENTS

Figure 1:
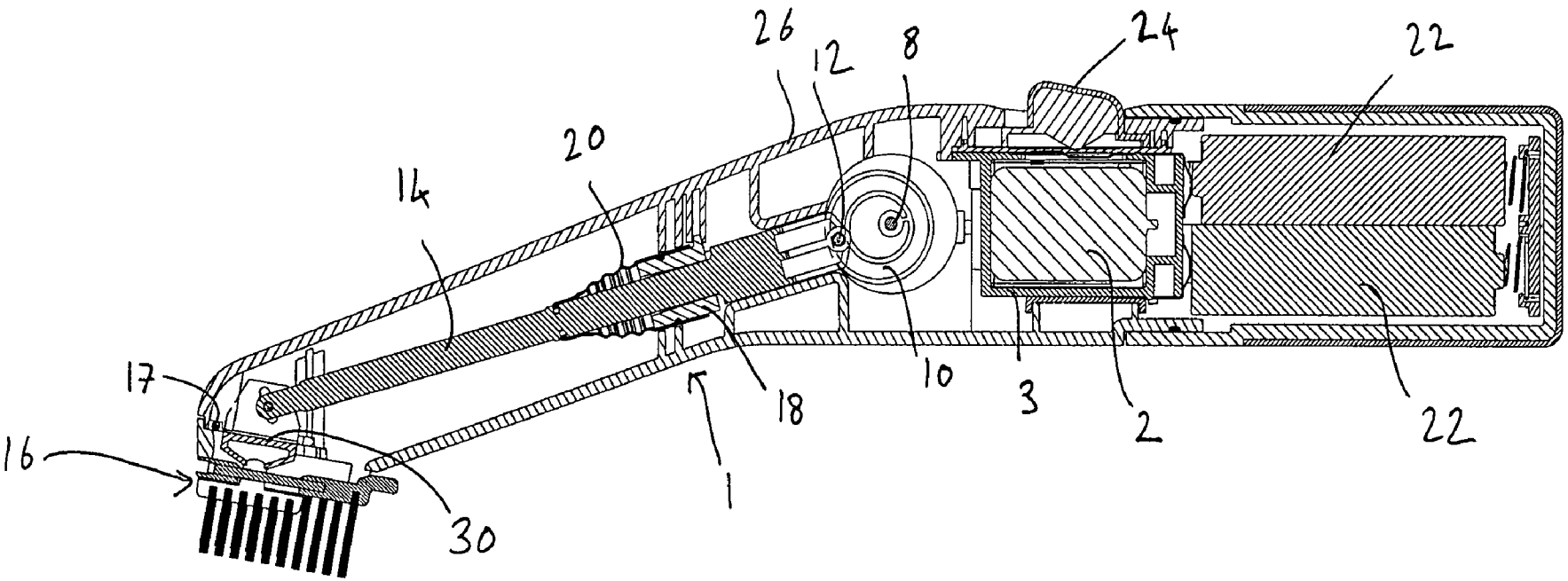
FIG. 1 is a cross-sectional view through an electric brush including a reciprocating drive mechanism according to an embodiment of the invention.

FIG. 1 shows an electric brush assembly 1 which comprises a motor 2 encased in a motor housing 3. The motor 2 has a pinion 4 attached thereto which drives a crown wheel 6 mounted on a shaft 8 substantially perpendicular to the axis of the shaft of the motor 2. The crown wheel 6 carries a cam track 10 in which a cam follower pin 12 sits. The cam follower pin 12 is attached to a reciprocating push-pull rod 14. A brush head 16 is attached to the other end of the push-pull rod 14 to that attached to the cam follower pin 12. The push-pull rod 14 is guided in a guide bush 18 which is covered by a bellows-type gasket 20.

The motor 2 is driven by one or more batteries 22 mounted adjacent to it in the assembly 1 and is controlled by an on-off switch 24. The aforementioned components with the exception of the brush head 16 are encased in a housing 26.

The guide bush 18 may be in the form of a small tube retained within the housing 26 and extending along a portion of the longitudinal axis of the push-pull rod 14. The guide bush 18 constrains the motion of the push-pull rod 14.

Figure 2:
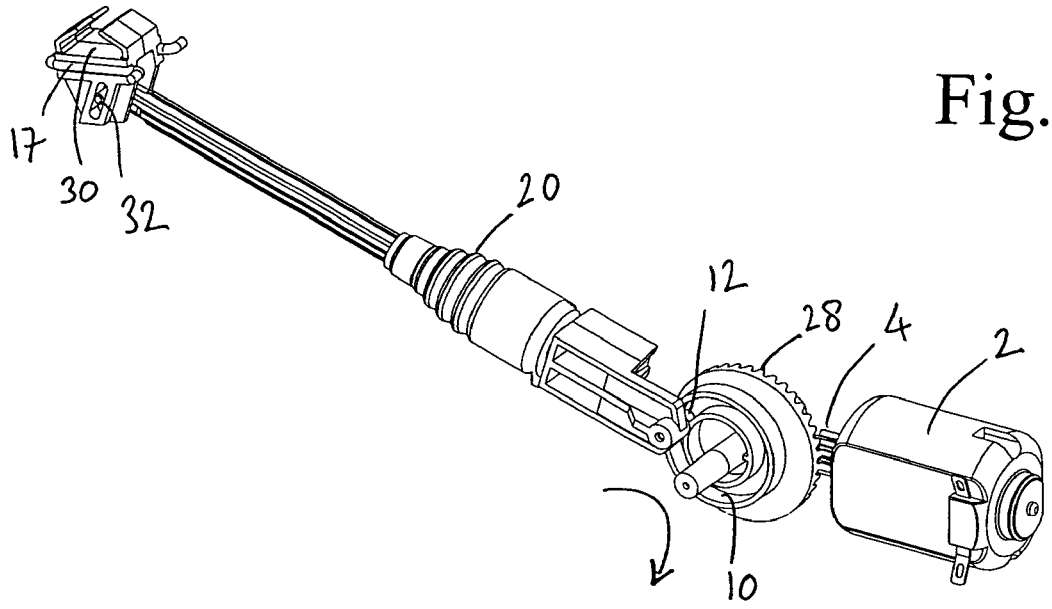
FIG. 2 is a perspective view of the reciprocating drive mechanism of FIG. 1 from a first side.
Figure 3:
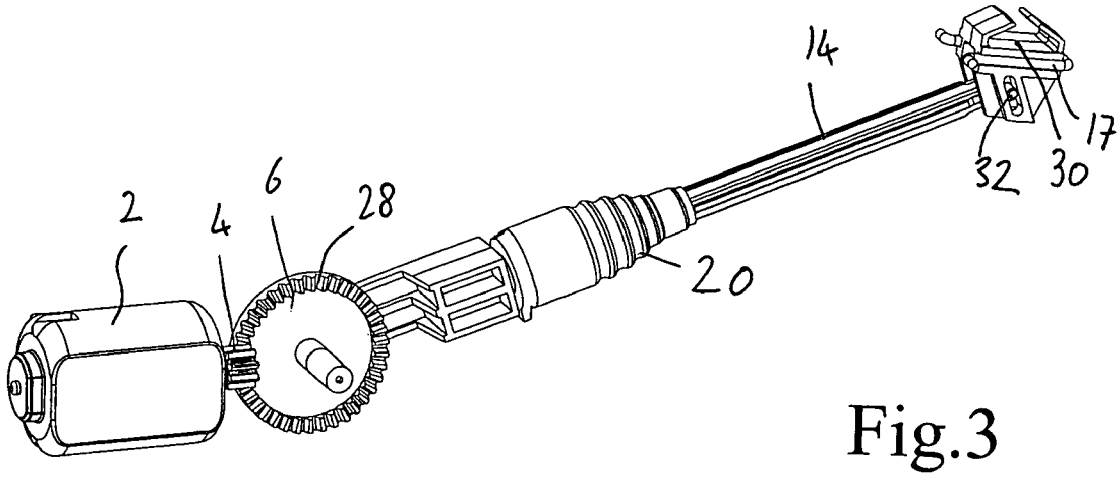
FIG. 3 is a perspective view of the reciprocating drive mechanism of FIG. 1 from the other side to that shown in FIG. 2.

FIGS. 2 and 3 show the reciprocating drive mechanism for an electric brush assembly 1 of the type shown in FIG. 1. The motor 2 carries the pinion gear 4 on one end of its shaft. The pinion gear 4 meshes with teeth 28 on the crown gear wheel 6. The cam track 10 which is carried on the crown gear wheel 6 is preferably in the form of a continuous groove.

The push-pull rod 14 has, at one end, the cam follower pin 12 mounted thereon substantially perpendicular to its axis, and the cam follower pin 12 fits into the groove of the cam track 10.

At the other end of the push-pull rod 14 to that carrying the cam follower pin 12, a drive block 30 is movably attached thereto. The brush head 16 is attachable to the drive block 30 which, in operation, drives the movement of the brush head 16. The drive block 30 is constrained to move over a U-shaped wire guide 17, with slots in opposite sides of the block 30 receiving edges of the guide whereby the block 30 can slide up and down the guide 17, being moved to and fro by the push-pull rod 14 connected to the drive block 30 via a drive pin 32 which extends through a slot in the drive block 30. The longitudinal axis of the drive pin 32 is substantially perpendicular to the longitudinal axis of the push-pull rod 14. The push-pull rod 14 passes through the bellows style gasket 20 which seals the gap between the push-pull rod 14 and the inner surface of the housing 26.

Figure 6A:
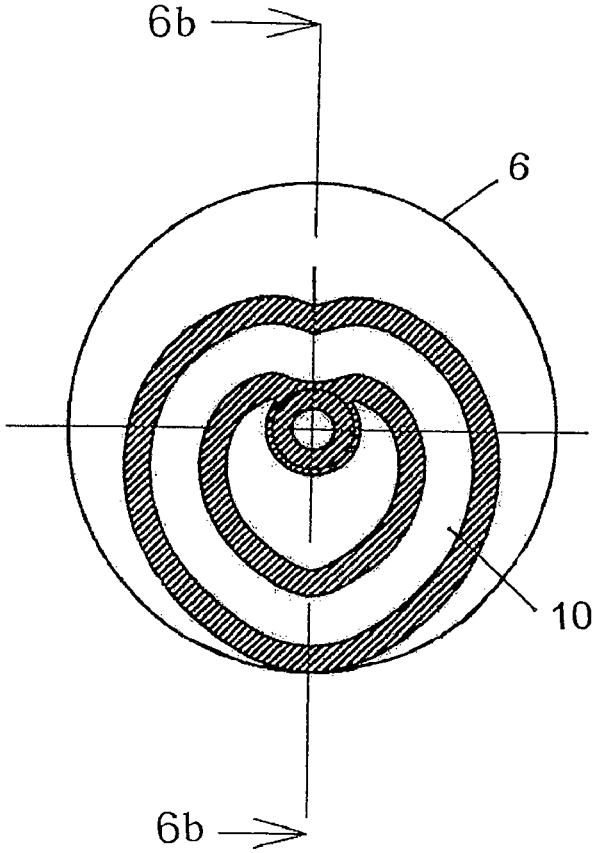
FIG. 6*a* is a plan view of a crown gear wheel showing a sectional view of a cam track of cardioid peripheral shape.
Figure 6B:
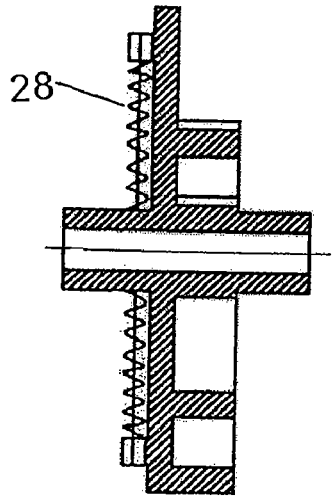
FIG. 6*b* is a cross-sectional view of FIG. 6*a* taken along section lines 6*b*-6*b*.

In operation, the user starts the motor 2 by depressing the on-off switch 24. As the crown gear wheel 6 is rotated by the motor pinion gear 4, which is driven by the motor 2, the cam follower pin 12 follows the cam track 10 to produce the desired motion of the push-pull rod 14 along its longitudinal axis. Movement of the push-pull rod 14 along its longitudinal axis causes the drive block 30 to move slidably along its associated track in the housing 26, which causes reciprocating movement of the brush head 16 attached thereto. The push-pull rod 14 is constrained to move along its longitudinal axis by the guide bush 18. The shape of the cam track 10 and its positioning on the crown gear wheel 6 defines the motion of the push-pull rod 14. For example, a circular track which is offset from the centre of the crown gear wheel 6 will produce simple harmonic motion of the push-pull rod 14, and more particularly, a sinusoidal motion of slowly changing direction. The cardioid track shown in FIG. 6*a* will produce a uniform velocity in both the forward and backward motion and a change of direction of the simple harmonic motion of the push-pull rod 14.

Figure 4:
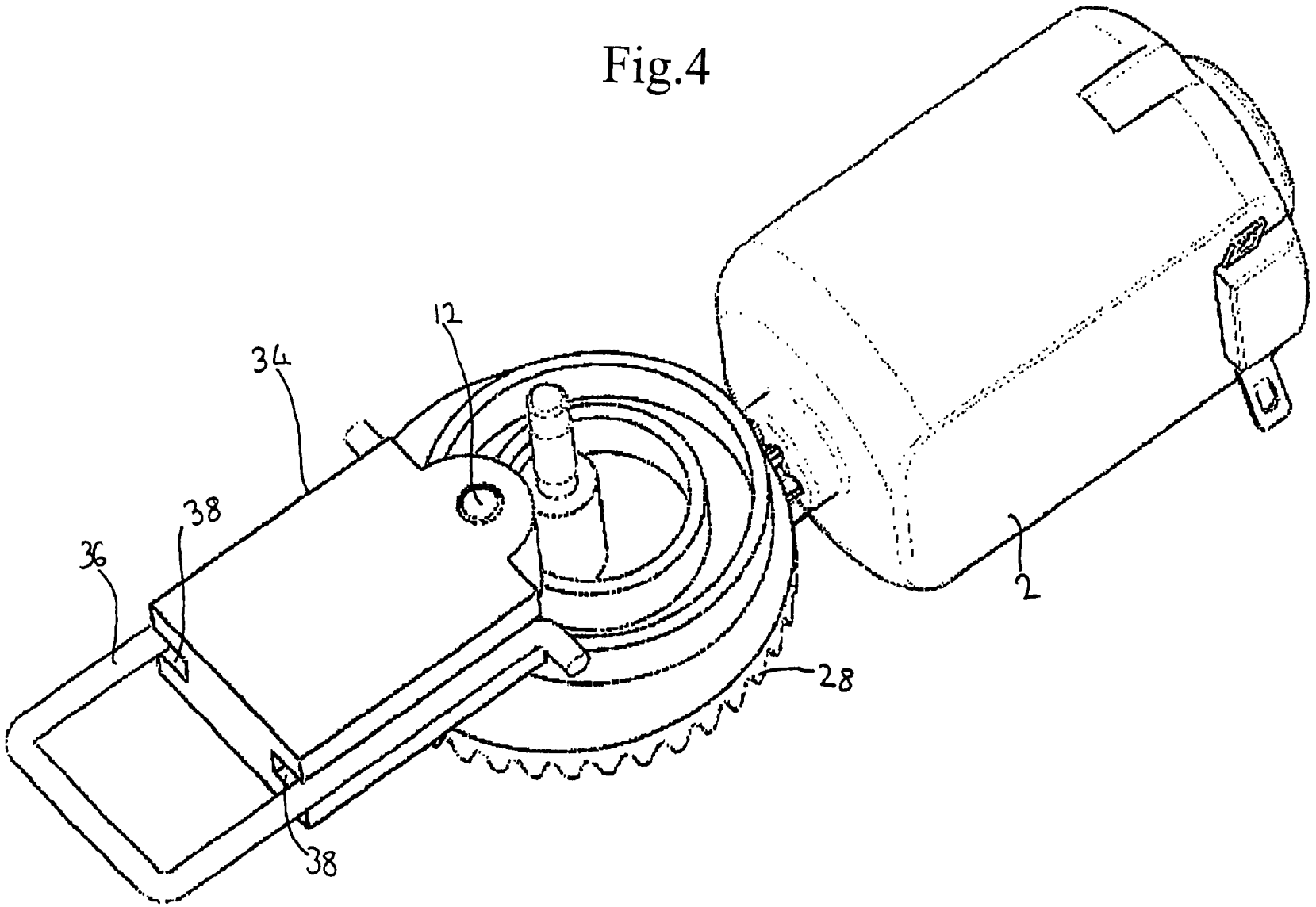
FIG. 4 is a perspective view of a reciprocating drive mechanism according to a further preferred embodiment of the invention.
Figure 5:
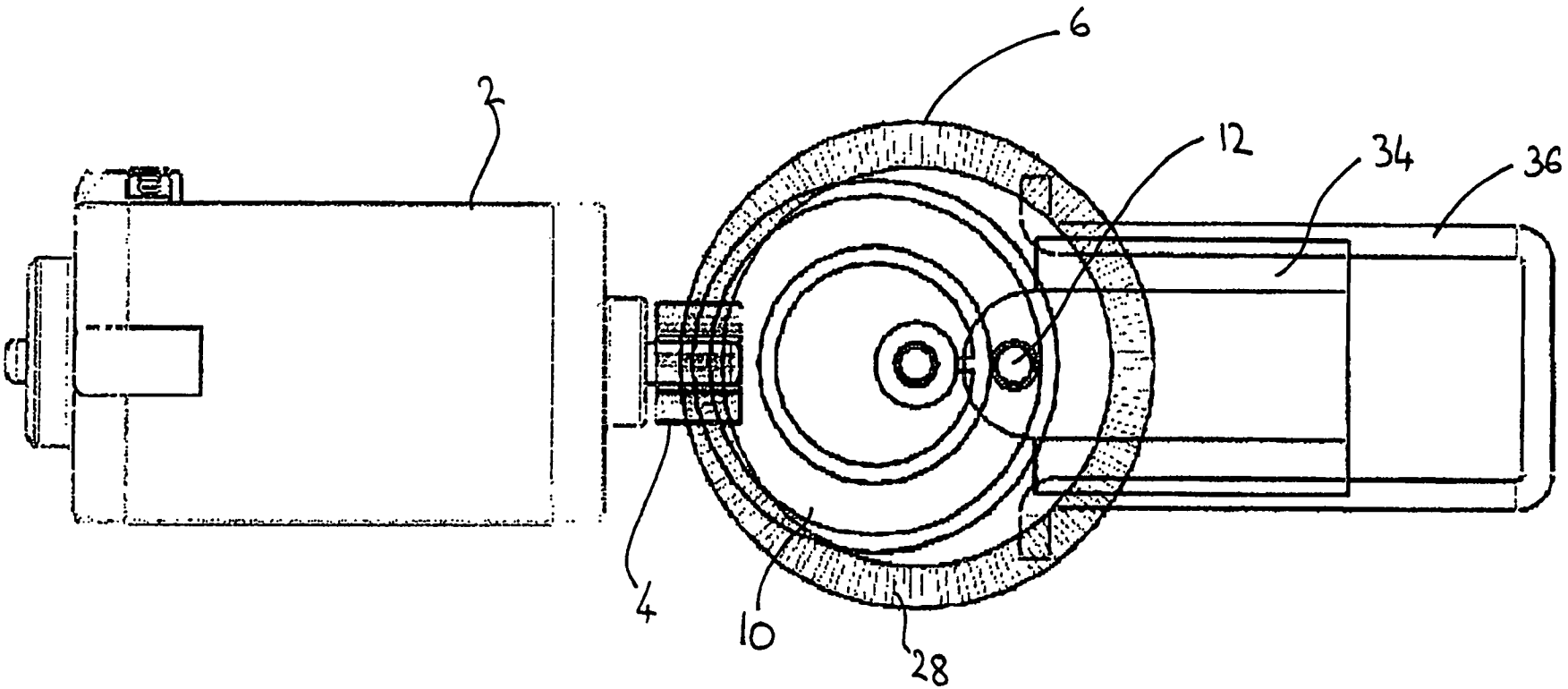
FIG. 5 is a plan view of the reciprocating drive mechanism shown in FIG. 4.

FIGS. 4 and 5 show an alternative reciprocating drive mechanism to those shown in FIGS. 1 to 3. In the embodiment of FIGS. 4 and 5, the push-pull rod 14 is removed from the assembly and the cam follower 12 is mounted directly on a drive block/plate 34. A brush (not shown) is mounted on one face of the drive block/plate 34.

The operation of the reciprocating drive mechanism shown in FIGS. 4 and 5 is essentially the same as that shown in FIGS. 1 to 3 as described above. However, in this alternative embodiment the drive block/plate 34 is directly coupled to the mechanism to move the brush head 16. As there is no push-pull rod 14 and no guide bush 18 to align it, the motion of the drive block/plate 34 is guided solely by a wire guide 36 mounted within the housing 26 and a groove 38 in either side of the drive block/plate 34. In practice the drive block/plate 34 slides along the wire guide 36 which engages in the grooves 38 in the drive block/plate 34 when driven by the cam follower pin 12 which follows the cam track 10. The drive block/plate 34 carries the brush head 16 and therefore movement of the drive block/plate 34 within the housing 26 on activation of the motor 2 causes movement of the brush head 16 attached thereto.

Various modifications to the embodiments of the present invention described above may be made. For example, whilst embodiments of the present invention have been described and illustrated herein in the context of an electric brush assembly and a reciprocating drive mechanism therefor, the present invention is not to be considered limited thereto as it is applicable for use in the context of other forms of electric tool assemblies. Also, other components and method steps may be added or substituted for those described above. Thus, although the invention has been described above using particular embodiments, many variations are possible within the scope of the claims, as will be clear to the skilled reader, without departing from the spirit and scope of the invention.

The invention claimed is:

1. A device for converting a rotating motion into a reciprocating motion comprising:

a first shaft rotatably carrying a first element having a cam groove therein;

a second element constrained to move along an axis of the second element; and a pin carried on the second element for engagement in the cam groove in the first element so that as the first element rotates, the pin being arranged to follow the cam groove causes the second element to move along the axis, the shape of the groove defining motion of the second element, wherein said first element comprises a crown wheel mountable axially on said first shaft and having a plurality of teeth on a first face, said device further comprising a motor with a second rotatable shaft and a pinion wheel mounted on the second shaft, said teeth engaging in use with teeth on the pinion wheel.

2. A device according to claim 1, wherein the first shaft extends longitudinally in a first plane, and a bottom surface of the groove in said first element is at substantially 90 degrees to the plane in which the first shaft extends longitudinally.

3. A device according to claim 1, further comprising a bristle head element attachable to a first free end of said second element.

4. A device according to claim 1, further comprising an abrasive head element attachable to a first free end of said second element.

5. A device according to claim 1, further comprising a sponge head element attachable to a first free end of said second element.

6. A device according to claim 1, wherein said second element comprises a push-pull rod.

7. A device according to claim 1, wherein said first element comprises a disc plate having the cam groove cut into said first element.

8. A device according to claim 1, further comprising a guide bush arranged to guide said second element.

9. A device according to claim 1, wherein said first shaft is driven by rotation of said second shaft such that said pinion wheel causes the crown wheel to rotate the first shaft.

10. A device according to claim 9, further comprising a battery to power the motor to effect rotation of the first shaft and/or the second shaft.

11. A device according to claim 1, wherein said groove in said first element has a circular peripheral shape and is offset relative to the longitudinal axis of the first shaft.

12. A device according to claim 1, wherein the groove in the first element has a cardioid peripheral shape.

13. A device according to claim 1, further comprising a battery to power rotation for the first shaft.

14. A device according to claim 1, further comprising a battery to power rotation of the second shaft.

15. A device according to claim 1, further comprising a housing for encasing the first shaft, the first element, the second element and the pin carried on the second element.

16. A device according to claim 15, wherein the housing is arranged to encase a motor for driving rotation of said first shaft.

17. An electric brush assembly comprising the device according to claim 1.

18. An electric tool assembly comprising the device according to claim 1.

* * * * *